US008536478B2

(12) United States Patent
Li et al.

(10) Patent No.: US 8,536,478 B2
(45) Date of Patent: Sep. 17, 2013

(54) SLIDABLE BUTTON AND ELECTRONIC DEVICE USING THE SAME

(75) Inventors: Hong Li, Shenzhen (CN); Ting-Ting Zhao, Shenzhen (CN); Xiao-Hui Zhou, Shenzhen (CN); Min-Li Li, Shenzhen (CN)

(73) Assignees: Hong Fu Jin Precision Industry (Shen Zhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 184 days.

(21) Appl. No.: 13/172,832

(22) Filed: Jun. 30, 2011

(65) Prior Publication Data

US 2012/0145524 A1 Jun. 14, 2012

(30) Foreign Application Priority Data

Dec. 9, 2010 (CN) ..... 2010 1 0580845

(51) Int. Cl.
*H01H 15/10* (2006.01)

(52) U.S. Cl.
USPC ..... 200/547; 200/536

(58) Field of Classification Search
USPC ..... 200/546, 547, 536, 314, 341, 252, 200/338
See application file for complete search history.

(56) References Cited

U.S. PATENT DOCUMENTS

| | | | | |
|---|---|---|---|---|
| 4,190,754 | A * | 2/1980 | Kilar | 200/329 |
| 5,122,627 | A * | 6/1992 | Trana | 200/548 |
| 6,930,264 | B2 * | 8/2005 | Nagai et al. | 200/252 |
| 7,633,030 | B2 * | 12/2009 | Chang | 200/341 |
| 2008/0060929 | A1 * | 3/2008 | Iijima | 200/547 |
| 2011/0182047 | A1 * | 7/2011 | Ouyang | 361/807 |
| 2011/0228494 | A1 * | 9/2011 | Xiao | 361/752 |

* cited by examiner

*Primary Examiner* — Briggitte R Hammond
(74) *Attorney, Agent, or Firm* — Altis Law Group, Inc.

(57) ABSTRACT

An exemplary electronic device includes a casing with a slot defined in an outer face of the casing, a through holed defined in the slot, and a switch module. The switch module includes a switch received in the casing, and a slidable button embedded in the slot. The slidable button includes an operating portion received in the slot and abutting an outer face of the casing, a holding portion extending outwardly from the operating portion and through the through hole, and two elastic arms respectively extending outwardly from two lateral sides of the holding portion. Each elastic arm includes a connecting section extending outwardly from the holding portion and a locking section protruding outwardly from the connecting section towards the operating portion. The locking sections of the elastic arms abut an inner face of the casing, whereby the slidable button is fixed to the casing.

20 Claims, 7 Drawing Sheets

SLIDABLE BUTTON AND ELECTRONIC DEVICE USING THE SAME

BACKGROUND

1. Technical Field

The present disclosure relates to a slidable button and an electronic device using the slidable button.

2. Description of Related Art

Usually, an electronic device such as a Digital Versatile Disc (DVD) player has a slidable button to control a working state thereof. That is, the slidable button turns on and turns off the electronic device. However, in manufacturing, it is difficult to assemble the slidable button onto the electronic device without tools.

What is needed, therefore, is an electronic device having a slidable button which can overcome the above-described problems.

BRIEF DESCRIPTION OF THE DRAWINGS

Many aspects of the present slidable button and electronic device can be better understood with reference to the following drawings. The components in the drawings are not necessarily drawn to scale, the emphasis instead being placed upon clearly illustrating the principles of the present slidable button and electronic device. Moreover, in the drawings, like reference numerals designate corresponding parts throughout the several views.

DETAILED DESCRIPTION

Figure 1:
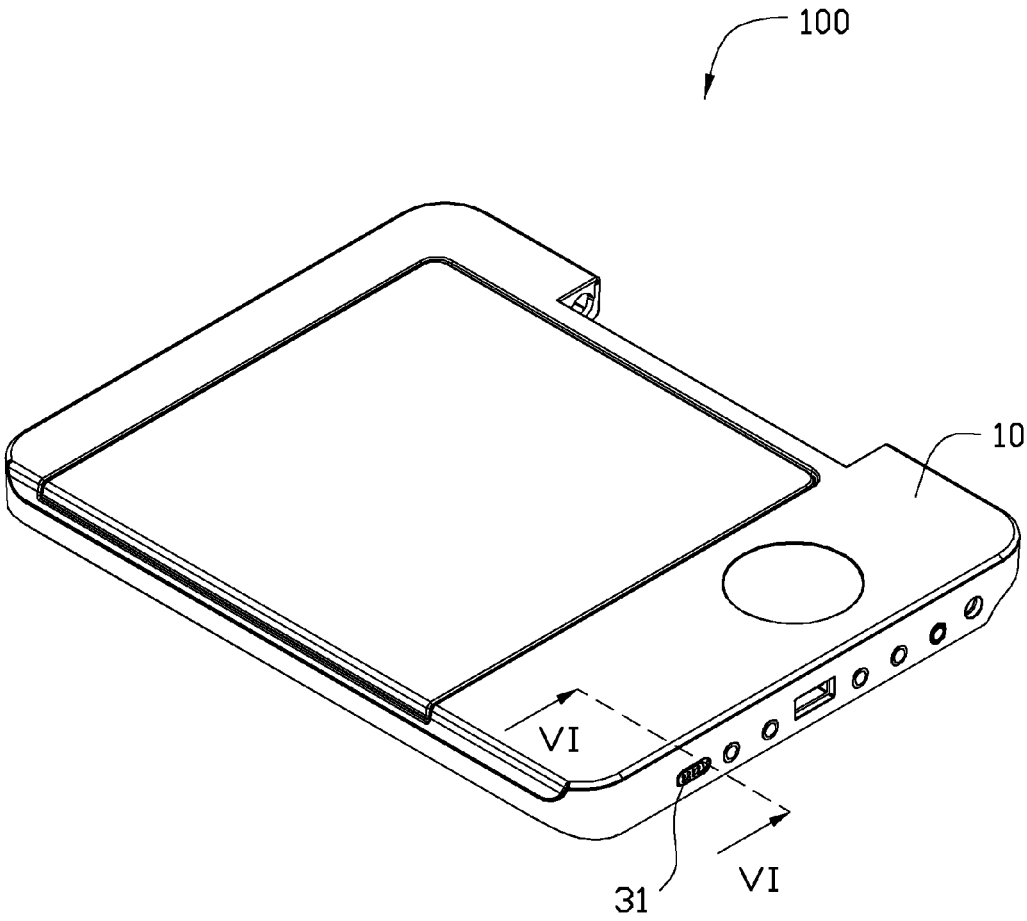
FIG. 1 is an assembled, isometric view of an electronic device in accordance with an exemplary embodiment of the disclosure.
Figure 2:
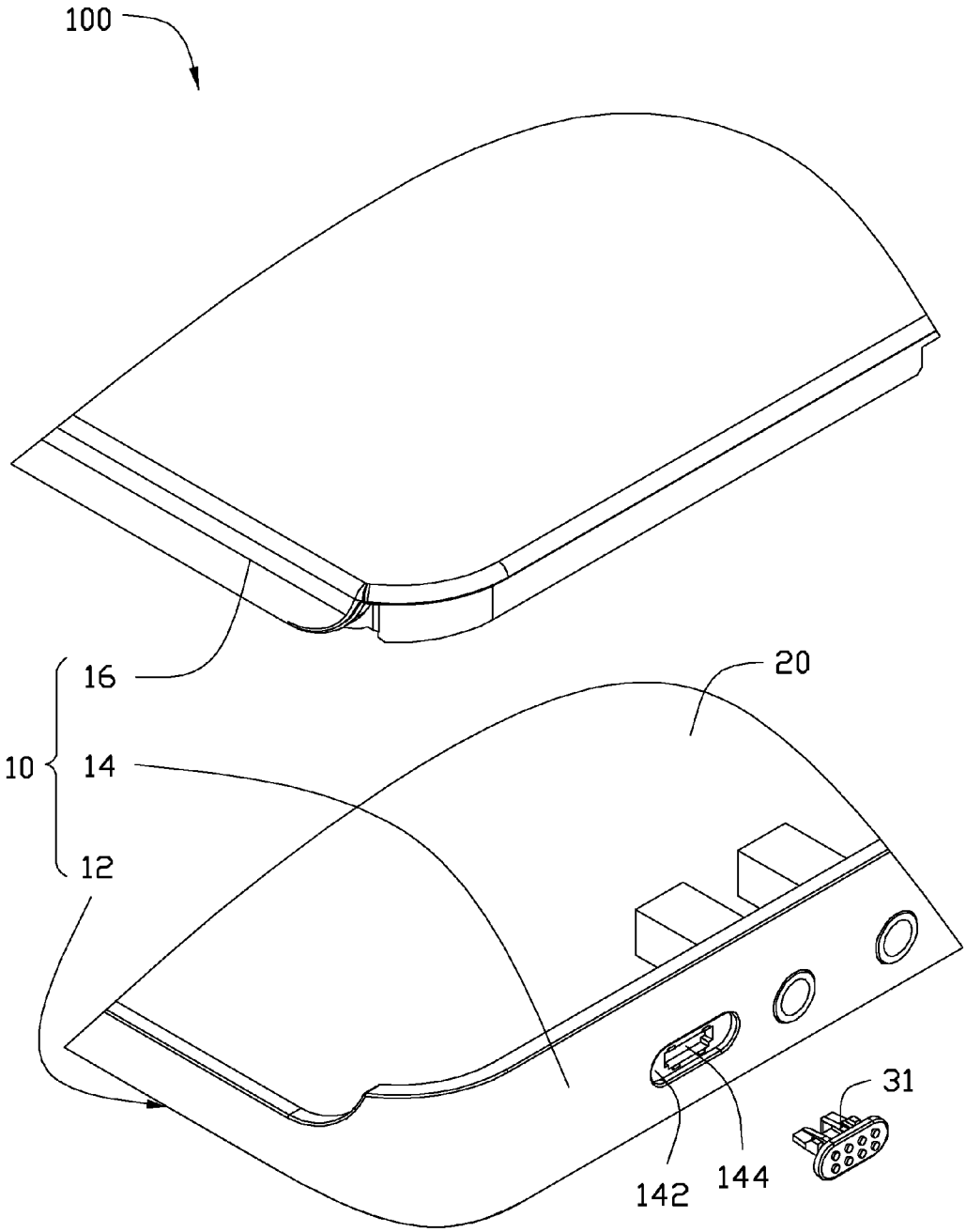
FIG. 2 is an exploded, enlarged view of part of the electronic device of FIG. 1.
Figure 3:
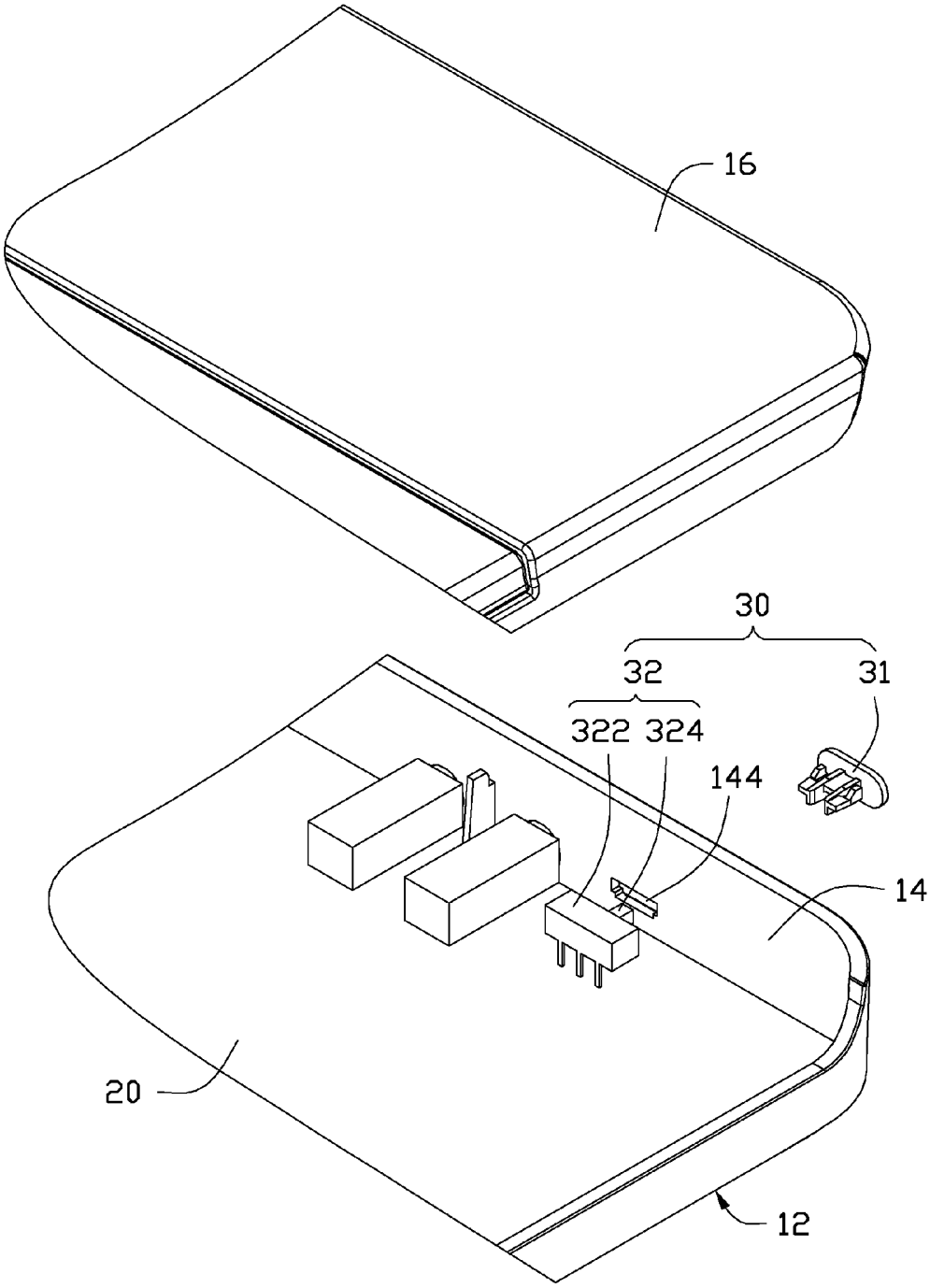
FIG. 3 is similar to FIG. 2, but showing the parts from another aspect.

Referring to FIGS. 1-3, an electronic device 100 in accordance with an exemplary embodiment of the present disclosure is illustrated. The electronic device 100 comprises a casing 10, a printed circuit board 20 received in the casing 10, and a switch module 30 fixed to the casing 10.

The casing 10 is a rectangular hollow body, which is made from aluminum, steel, or alloy, or composite material such as carbon fiber. The casing 10 comprises a rectangular base plate 12, an annular frame 14 extending from a periphery of the base plate 12, and a cover 16 located on the frame 14. The printed circuit board 20 is fixed on the base plate 12 of the casing 10.

An elongated slot 142 is defined in an outer face of the frame 14, for receiving the switch module 30 therein. A through hole 144 is defined in the frame 14, and is located corresponding to a center of the slot 142. A dimension of the through hole 144 is smaller than that of the slot 142. The through hole 144 has a rectangular profile.

The switch module 30 comprises a slidable button 31 movably seated in the slot 142, and a switch member 32 engaging with the slidable button 31. The switch member 32 comprises a main portion 322, and a switch 324 extending outwardly from the main portion 322. The switch member 32 is electrically fixed on the printed circuit board 20 and located adjacent to the through hole 144. The switch 324 is the part of the switch member 32 nearest to the through hole 144, and faces the through hole 144. The switch 324 is able to be slid relative to the main portion 322, for controlling a working state of the electronic device 100. That is, the switch 324 turns on and turns off the electronic device 100.

Figure 4:
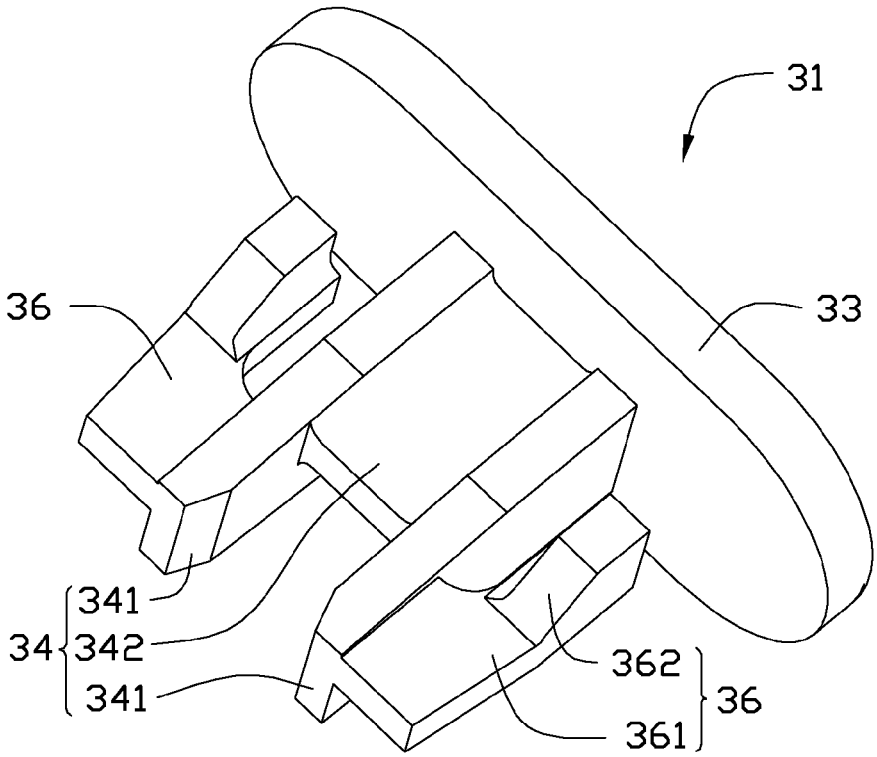
FIG. 4 is an enlarged view of a slidable button of the electronic device of FIG. 1.

Referring to FIG. 4 also, the slidable button 31 comprises an upright operating portion 33, a holding portion 34 extending outwardly and horizontally from the operating portion 33, and two elastic arms 36 respectively extending outwardly from two lateral sides of the holding portion 34. The operating portion 33 has a profile like that of the slot 142. The operating portion 33 is received in the slot 142, and able to slide in the slot 142 from one end of the slot 142 to an opposite end of the slot 142.

The holding portion 34 comprises two spaced holding arms 341 respectively protruding outwardly from the operating portion 33, and a main body 342 interconnecting the two holding arms 341. The two holding arms 341 are located respectively at two lateral sides of the main body 342. The two holding arms 341 are symmetrical relative to the main body 342. A distance between the two holding arms 341 is equal to or a little smaller than a width of the switch 324.

Each of the elastic arms 36 comprises a connecting section 361 extending outwardly from an outer lateral face of a corresponding holding arm 341 of the holding portion 34, and a locking section 362 protruding backward from the connecting section 361, i.e. towards the operating portion 33. The connecting section 361 extends from an end portion of the holding arm 341 remote from the operating portion 33. A distal end of the connecting section 361 is flush with corresponding distal ends of the holding arms 341. The connecting section 361 has an end face coplanar with an end face of the holding arm 341 at the distal ends of the connecting section 361 and the holding arm 341. Each locking section 362 is spaced from the operating portion 33 and from the holding portion 34. In other words, the locking sections 362 are separated from the operating portion 33 by two gaps, respectively. The locking section 362 is spaced from the holding portion by a through pore between the locking section 362 and the holding arm 341. The two elastic arms 36 are symmetrical relative to the holding portion 34. A distance between a top face of each locking section 362 and a bottom face of the holding portion 34 is a little larger than a height of the through hole 144. A top end of each locking section 362 is chamfered for facilitating extension through the through hole 144. A top face of the connecting section 361 of each elastic arm 36 is coplanar with a top face of the holding portion 34. A top face of the locking section 362 of each elastic arm 36 is located higher that that of the holding portion 34.

Figure 5:
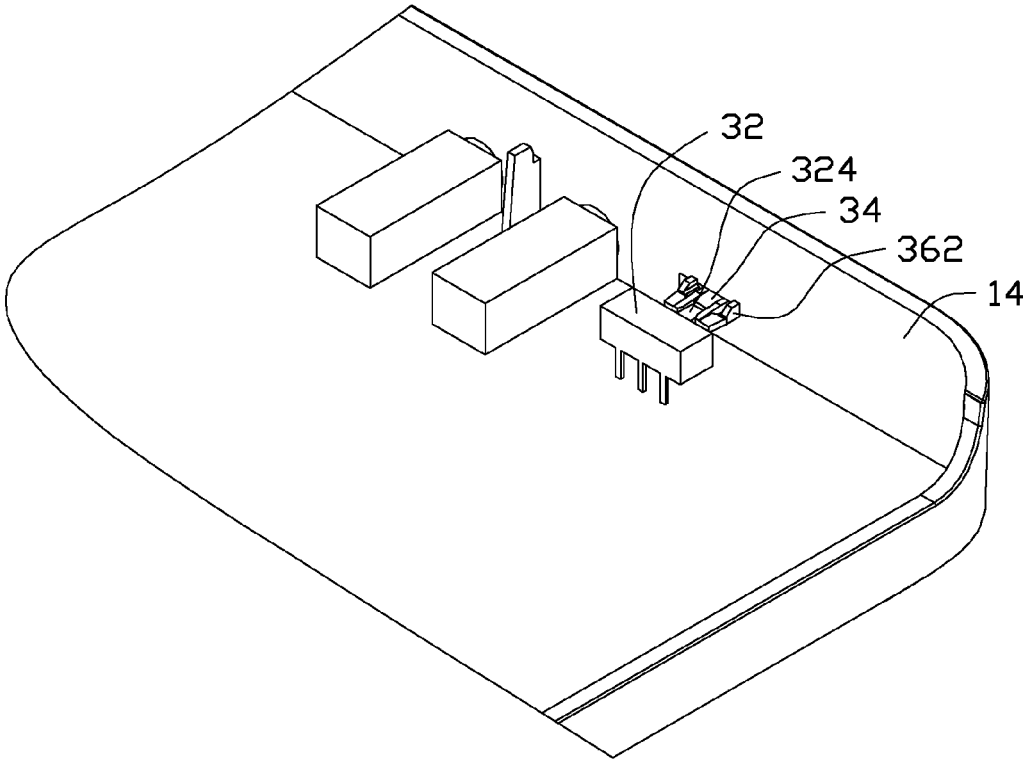
FIG. 5 is an assembled view of the electronic device shown in FIG. 3, but omitting a cover thereof.
Figure 6:
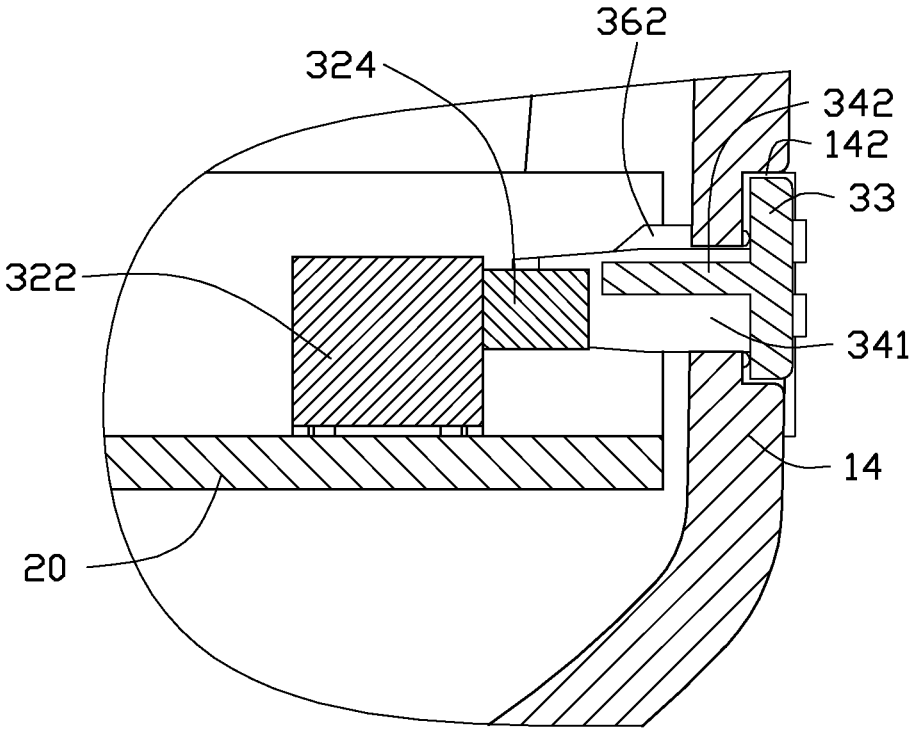
FIG. 6 is a cross section view of the electronic device of FIG. 1, taken along line VI-VI thereof.
Figure 7:
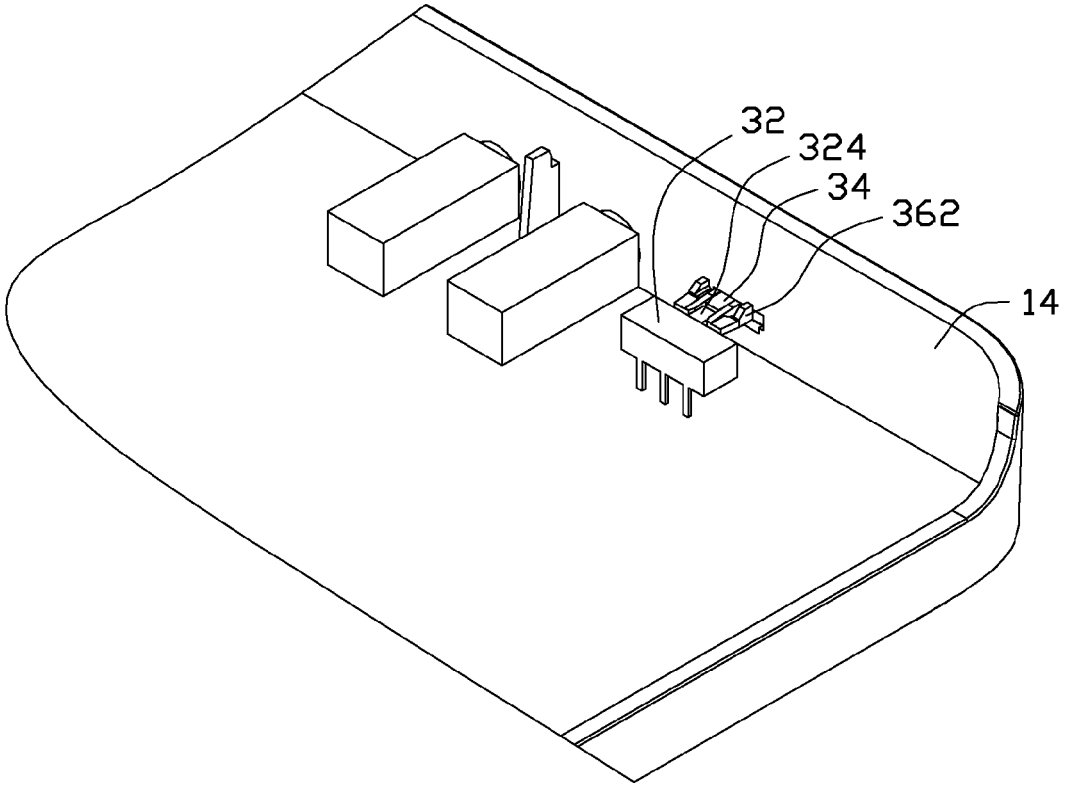
FIG. 7 is similar to FIG. 5, but showing a slidable button thereof slid to a different position.

Referring to FIGS. 5-7 also, assembly of the electronic device 100 is as follows. In a process of inserting the slidable button 31 into the through hole 144 of the casing 10, the locking sections 362 are able to be pressed downwardly until they pass though the through hole 144, due to the resilience of the locking sections 362. After the locking sections 362 have passed through the through hole 144, the locking sections 362 resile to abut against an inner face of the frame 14, and a corresponding portion of the frame 14 is sandwiched between the locking sections 362 and the operating portion 33. Meanwhile, the operating portion 33 is received in the slot 142 and abuts against the outer face of the casing 10 at an inmost extremity of the slot 142, whereby the slidable button 31 is slidably engaged in the casing 10. The operating portion 33 is slidably seated into the slot 142. The switch 324 is sandwiched between the two holding arms 341 of the holding portion 34, whereby when the operating portion 33 is slid along the slot 142, the switch 324 follows the movement of the operating portion 33. Thus the switch 324 is able to control the working state of the electronic device 100 via operation of the slidable button 31 by a user.

It is to be understood, however, that even though numerous characteristics and advantages of the present disclosure have been set forth in the foregoing description, together with details of the structures and functions of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An electronic device comprising:

a casing with a slot defined in an outer face thereof, and a through hole defined in the casing at the slot; and a switch module comprising a switch received in the casing, and a slidable button movably seated in the slot, the slidable button comprising an operating portion received in the slot and abutting the outer face of the casing at an inmost extremity of the slot, a holding portion extending from the operating portion and through the through hole, and two elastic arms respectively extending outwardly from two lateral sides of the holding portion, each elastic arm comprising a connecting section extending outwardly from the holding portion and a locking section protruding outwardly from the connecting section towards the operating portion, the locking sections of the elastic arms abutting an inner face of the casing, whereby the slidable button is slidably fixed to the casing, the holding portion comprising two spaced holding arms and a main body connecting the two holding arms, the connecting section having a distal end flush with distal ends of the holding arms.

2. The electronic device of claim 1, wherein the operating portion is available to slide along the slot.

3. The electronic device of claim 1, wherein the two elastic arms are symmetrical relative to the holding portion.

4. The electronic device of claim 1, wherein a top end of the locking section of each elastic arm is chamfered for facilitating extending through the through hole.

5. The electronic device of claim 1, wherein the casing comprises a rectangular base plate, an annular frame extending upwardly from a periphery of the base plate, and a cover located on the frame, the slot being defined in the frame.

6. The electronic device of claim 1, wherein the connecting section has an end face coplanar with an end face of the holding arm at the distal ends of the connecting section and the holding arm.

7. The electronic device of claim 1, wherein the locking sections of the elastic arms are spaced from the operating portion, and the holding portion.

8. The electronic device of claim 7, wherein each of the locking sections is spaced from the holding portion by a through pore defined between the locking section and a corresponding holding arm.

9. The electronic device of claim 7, wherein the two spaced holding arms respectively protrude outwardly from the operating portion.

10. The electronic device of claim 9, wherein the switch is held between the two holding arms of the holding portion.

11. The electronic device of claim 7, wherein a distance between top faces of the locking sections and a bottom face of the holding portion is larger than a height of the through hole.

12. The electronic device of claim 11, wherein a top face of the locking section of each elastic arm is located higher than that of the connecting section, and that of the holding portion.

13. A slidable button adapted for engaging with a switch received in a casing of an electronic device, the slidable button comprising:

an operating portion adapted for abutting an outer face of the casing;

a holding portion extending from the operating portion and adapted for extending through the casing; and two elastic arms respectively extending outwardly from two lateral sides of the holding portion, each elastic arm comprising a connecting section extending outwardly from the holding portion and a locking section protruding outwardly from the connecting section towards the operating portion, the locking sections of the elastic arms being adapted for abutting an inner face of the casing, the holding portion comprising two holding arms and a main body connecting the two holding arms, the connecting section having a distal end flush with distal ends of the holding arms.

14. The slidable button of claim 13, wherein the two elastic arms are symmetrical relative to the holding portion.

15. The slidable button of claim 13, wherein a top end of the locking section of each elastic arm is chamfered for facilitating extending through the casing.

16. The slidable button of claim 13, wherein the connecting section has an end face coplanar with an end face of the holding arm at the distal ends of the connecting section and the holding arm.

17. The slidable button of claim 13, wherein the locking sections of the elastic arms are spaced from the operating portion.

18. The slidable button of claim 17, wherein the locking sections of the elastic arms are spaced from the holding portion by two through pore defined between the locking sections and the holding portion, respectively.

19. The slidable button of claim 18, wherein the two spaced holding arms respectively protrude outwardly from the operating portion, the holding arms being for holding the switch therebetween.

20. The slidable button of claim 19, wherein a top face of the locking section of each elastic arm is located higher than that of the connecting section, and that of the holding portion.

* * * * *